US005613564A

United States Patent [19]

Rhines

[11] Patent Number: 5,613,564

[45] Date of Patent: Mar. 25, 1997

[54] VEHICLE ENGINE FIRE EXTINGUISHER APPARATUS

[76] Inventor: Andy J. Rhines, Rte. 1, Box 320-R, Van, Tex. 75790

[21] Appl. No.: 509,449

[22] Filed: Jul. 31, 1995

[51] Int. Cl.[6] ..... A62C 3/07

[52] U.S. Cl. ..... 169/61; 169/62

[58] Field of Search ..... 169/19, 26, 56, 169/60, 61, 62

[56] References Cited

U.S. PATENT DOCUMENTS

| | | | |
|---|---|---|---|
| 2,841,228 | 7/1958 | Porterfield | 169/62 X |
| 3,387,662 | 6/1968 | Molgano, Jr. | 169/62 X |
| 3,568,774 | 3/1971 | Meoule | 169/60 |
| 3,630,288 | 12/1971 | Tiberti et al. | 169/61 |
| 3,788,666 | 1/1974 | Kramer et al. | 169/61 X |
| 4,383,579 | 5/1983 | Monk | 169/62 |
| 4,423,784 | 1/1984 | Bolen | 169/62 |
| 4,718,498 | 1/1988 | Davios et al. | 169/62 |
| 4,905,765 | 3/1990 | Hein | 169/61 |
| 4,986,365 | 1/1991 | Shieh | 169/60 |
| 5,119,878 | 6/1992 | Lee | 169/62 |

FOREIGN PATENT DOCUMENTS

| | | | |
|---|---|---|---|
| 2674441 | 10/1992 | France | 169/62 |

*Primary Examiner*—Andrew C. Pike

[57] ABSTRACT

A fire extinguisher apparatus is provided for preventing and extinguishing fires in an engine compartment of a motor vehicle. The apparatus includes a collision sensor assembly supported by the motor vehicle and a fire extinguisher module supported by the motor vehicle. The fire extinguisher module includes a valve assembly. A valve control assembly is electrically connected to the collision sensor assembly, is supported by the fire extinguisher module, and is employed for controlling the valve assembly. A manifold assembly is supported by the motor vehicle and is connected to the valve assembly. The manifold assembly receives a quantity of fire extinguishant from the fire extinguisher module when the valve assembly is operated by the valve control assembly. The manifold assembly includes a first manifold branch which extends along a first side of the engine compartment and includes a second manifold branch which extends along a second side of the engine compartment. A plurality of nozzle assemblies are supported by and are arrayed along the manifold branches. The nozzle assemblies direct flow of a quantity of fire extinguishant toward an engine positioned between the first manifold branch and the second manifold branch. The collision sensor assembly may be responsive to a collision-induced movement of a vehicle radiator assembly. A rollover sensor assembly may also be employed. A high-temperature sensor assembly may also be employed. An ignition-circuit-deactivator assembly may also be employed for opening the ignition circuit in response to a sensed condition.

11 Claims, 4 Drawing Sheets

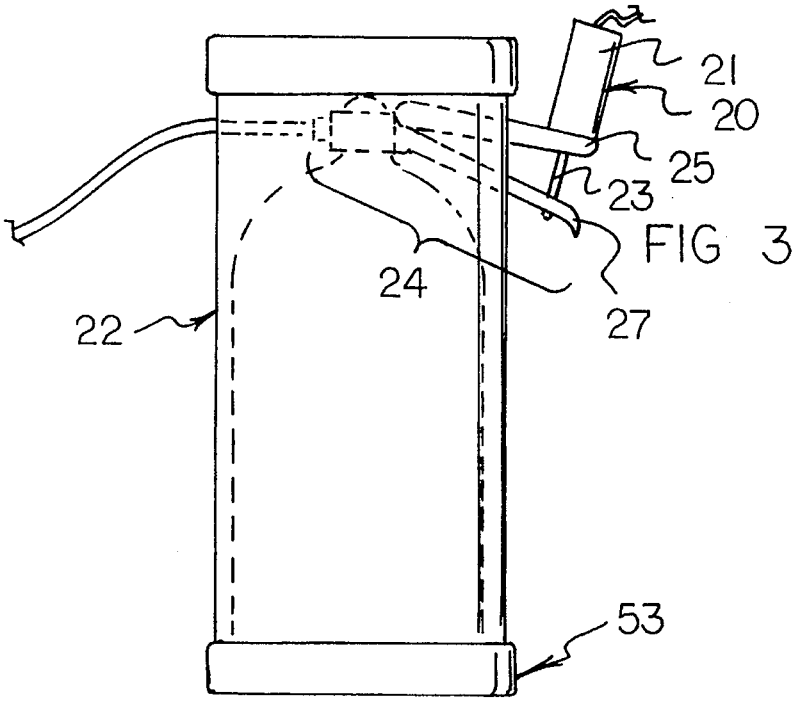
FIG 3
FIG 4
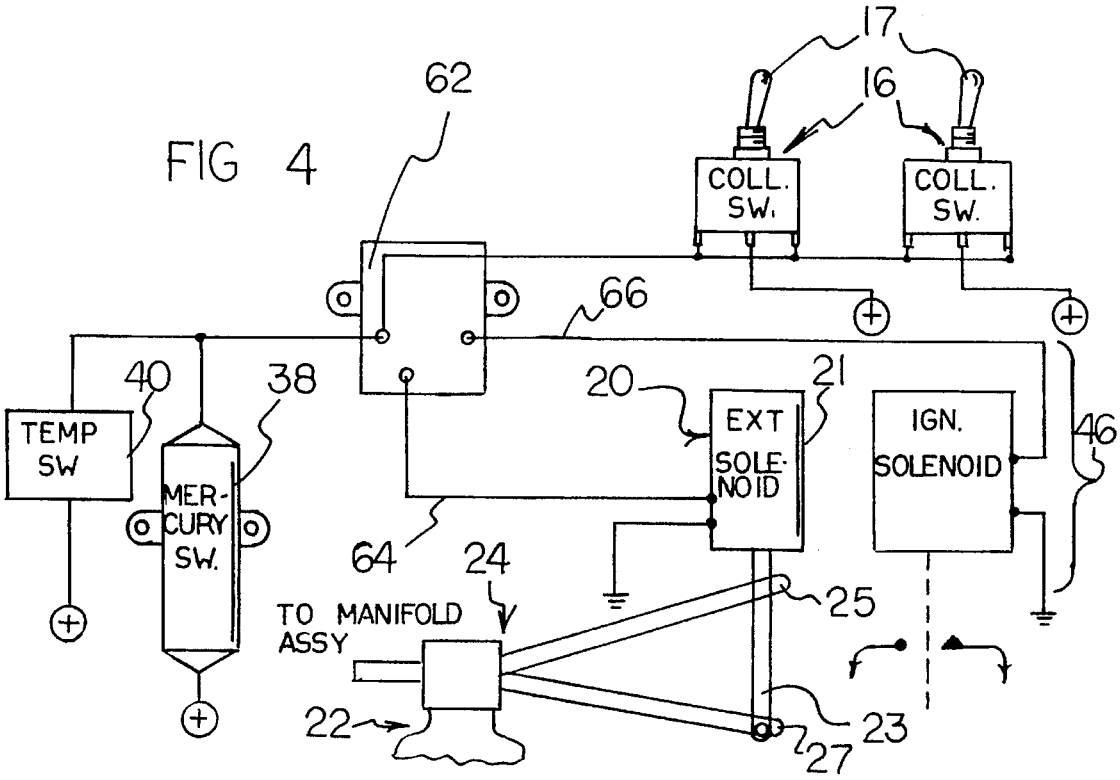

VEHICLE ENGINE FIRE EXTINGUISHER APPARATUS

BACKGROUND OF THE INVENTION

1. Field of the Invention

The present invention relates generally to fire extinguisher devices and, more particularly, to fire extinguisher devices especially adapted for extinguishing fires under the hood of a motor vehicle.

2. Description of the Prior Art

Fires under the hood of a motor vehicle are very dangerous occurrences. Moreover, there are numerous potential causes of such fires which include: a collision of the motor vehicle; an electrical short circuit or other electrical overload; and a gasoline leak, among others. Once an under-hood fire starts burning, there is generally not much that can be done to immediately stop the fire. For those motor vehicles which have a hand-carried fire extinguisher, one must first locate the fire extinguisher and then bring it to the hood area. Such actions take time, and, in the case of an under-hood fire, time is of the essence. In this respect, it would be desirable if a fire extinguisher were located under the motor vehicle hood so that it need not be carried there from another location in the motor vehicle.

It would even be more desirable if a fire extinguisher were automatically activated under the hood of a motor vehicle in the event of an under-hood fire. Throughout the years, a number of innovations have been developed relating to fire extinguishers for under-hood fires, and the following U.S. Pat. Nos. are representative of some of those innovations: 3,568,774; 4,383,579; 4,423,784; 4,986,365; and 5,119,878. More specifically, U.S. Pat. No. 3,568,774 discloses an automatic fire extinguisher that is activated by heat. Although such a device is desirable in the case when a fire has broken out, such a device does not serve to prevent the occurrence of a fire. In this respect, it would be desirable if an under-hood fire extinguisher were automatically activated upon the occurrence of a collision, before a fire actually breaks out.

U.S. Pat. No. 4,383,579 discloses a shock actuated fire prevention system for automobiles that depends upon trip wires for activating a system for dispensing a fire extinguishant. The use of trip wires is quite complex. In this respect, it would be desirable if a fire extinguisher for an automobile does not employ trip wires.

U.S. Pat. No. 4,423,784 discloses a manually operated fire extinguisher that distributes a fire extinguishant to under the hood. As stated above, it would be desirable if an automobile fire extinguisher were automatically activated.

U.S. Pat. No. 4,986,365 discloses an automatically activated, inertia-responsive, under-hood fire extinguisher which is located in one location under the hood and sprays a fire extinguishant from that one under-hood location to other regions under the hood. Because of the single location of the fire extinguishant, the concentration of the fire extinguishant received by an under-hood fire decreases the farther away from the that the under-hood fire is. Because such a concentration gradient of fire extinguishant under the hood of a motor vehicle is not desirable, it would be desirable if a fire extinguisher system had a plurality of fire extinguishant dispensers under the hood so that reduced concentration gradients of the fire extinguishant are provided under the hood.

U.S. Pat. No. 5,119,878 discloses an inertia-sensitive switch which is manufactured into an assembly that is combined with a fire extinguisher. Such a manufactured system has a disadvantage of not being able to use off-the-shelf components that can be used for retrofitting a motor vehicle.

Still other features would be desirable in a vehicle engine fire extinguisher apparatus. To distribute a fire extinguishant evenly under the hood of an automobile, it would be desirable if a distribution assembly were provided which were specifically designed for substantially even distribution of the fire extinguishant under the hood.

When an automobile collision occurs, it is most often in the front of the vehicle. When a collision occurs at the front of a vehicle, the automobile radiator is one of the first automobile structures to experience the impact. In this respect, it would be desirable if a fire extinguisher for an automobile were responsive to collision impact force on the radiator of the automobile.

When an automobile rolls over, such a condition may be a prelude to an under-hood fire. Therefore, it would be desirable if a vehicle engine fire extinguisher apparatus were automatically activated when the vehicle rolls over.

One cause of fires under the hood is due to uncontrolled electrical discharge. In this respect, it would be desirable if a fire extinguisher for an automobile were automatically activated in conjunction with automatically opening up the automobile ignition circuit.

Thus, while the foregoing body of prior art indicates it to be well known to use automatically activated fire extinguishers for under the hood of a motor vehicle, the prior art described above does not teach or suggest a vehicle engine fire extinguisher apparatus which has the following combination of desirable features: (1) is located under the motor vehicle hood so that it need not be carried there from another location; (2) is automatically activated under the hood of a motor vehicle in the event of an under-hood fire; (3) uses off-the-shelf components that can be used for retrofitting a motor vehicle; (4) is automatically activated upon the occurrence of a collision, before a fire actually breaks out; (5) does not employ trip wires; (6) provides a reduction of concentration gradients of the fire extinguishant under the hood; (7) is specifically designed for substantially even distribution of the fire extinguishant under the hood; (8) is responsive to collision impact force on the radiator of the automobile; (9) is automatically activated when the vehicle rolls over; and (10) is automatically activated in conjunction with automatically opening up the automobile ignition circuit. The foregoing desired characteristics are provided by the unique vehicle engine fire extinguisher apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a fire extinguisher apparatus for preventing and extinguishing fires in an engine compartment of a motor vehicle. The apparatus includes a collision sensor assembly supported by the motor vehicle and a fire extinguisher module supported by the motor vehicle. The fire extinguisher module includes a valve assembly. A valve control assembly is electrically connected to the collision sensor assembly. The valve control assembly is supported by the fire extinguisher module and is employed for controlling the valve assembly. A manifold assembly is supported by the motor vehicle and is connected to the valve assembly. The manifold assembly receives a quantity of fire extinguishant from the fire extinguisher module when the valve assembly is operated by the valve control assembly. The manifold assembly includes a first manifold branch which extends along a first side of the engine compartment and includes a second manifold branch which extends along a second side of the engine compartment. A plurality of first nozzle assemblies are supported by and are arrayed along the first manifold branch. A plurality of second nozzle assemblies are supported by and are arrayed along the second manifold branch. The first nozzle assemblies and the second nozzle assemblies direct flow of a quantity of fire extinguishant toward an engine positioned between the first manifold branch and the second manifold branch.

The collision sensor assembly may be responsive to a collision-induced movement of a vehicle radiator assembly. In such a case, the collision sensor assembly includes an activator arm. A collision-sensor-support bracket is supported by the motor vehicle. The collision sensor assembly is supported by the collision-sensor-support bracket, and a radiator-supported sensor activator is supported by the vehicle radiator assembly. The radiator-supported sensor activator operates the activator arm of the collision sensor assembly when a collision occurs and the vehicle radiator assembly moves longitudinally towards or away from the motor vehicle.

The radiator-supported sensor activator includes a slot portion for receiving the activator arm of the collision sensor assembly.

The valve assembly includes a first handle portion and a second handle portion. The valve control assembly includes a main-body portion attached to the first handle portion and includes a solenoid portion connected to the second handle portion.

Each of the first nozzle assemblies and the second nozzle assemblies includes a fan-shaped nozzle portion and a right-angled nozzle support portion which supports the fan-shaped nozzle portion.

The manifold assembly may include a passenger-compartment portion which extends from the engine compartment to a passenger compartment of the motor vehicle.

The manifold assembly is comprised of straight segments and forty-five angular degree segments. In the manifold assembly, two forty-five angular degree segments are connected in series to form a ninety degree angular bend.

A rollover sensor assembly may also be employed. The rollover sensor assembly is supported by the motor vehicle and is electrically connected to the valve control assembly.

A high-temperature sensor assembly may also be employed. The high-temperature sensor assembly is supported by the motor vehicle and is electrically connected to the valve control assembly.

An ignition-circuit-deactivator assembly is supported by the motor vehicle. The ignition-circuit-deactivator assembly is connected to a portion of an ignition circuit for opening the ignition circuit in response to a sensed condition. The ignition-circuit-deactivator assembly includes a solenoid activated switch assembly connected in-line with the ignition circuit.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Still yet a further object of the present invention is to provide a new and improved vehicle engine fire extinguisher apparatus which is located under the motor vehicle hood so that it need not be carried there from another location.

Still another object of the present invention is to provide a new and improved vehicle engine fire extinguisher apparatus that is automatically activated under the hood of a motor vehicle in the event of an under-hood fire.

Yet another object of the present invention is to provide a new and improved vehicle engine fire extinguisher apparatus which uses off-the-shelf components that can be used for retrofitting a motor vehicle.

Even another object of the present invention is to provide a new and improved vehicle engine fire extinguisher apparatus that is automatically activated upon the occurrence of a collision, before a fire actually breaks out.

Still a further object of the present invention is to provide a new and improved vehicle engine fire extinguisher apparatus which does not employ trip wires.

Yet another object of the present invention is to provide a new and improved vehicle engine fire extinguisher apparatus that provides a reduction of concentration gradients of the fire extinguishant under the hood.

Still another object of the present invention is to provide a new and improved vehicle engine fire extinguisher apparatus which is specifically designed for substantially even distribution of the fire extinguishant under the hood.

Yet another object of the present invention is to provide a new and improved vehicle engine fire extinguisher apparatus that is responsive to collision impact force on the radiator of the automobile.

Still a further object of the present invention is to provide a new and improved vehicle engine fire extinguisher apparatus that is automatically activated when the vehicle rolls over.

Yet another object of the present invention is to provide a new and improved vehicle engine fire extinguisher apparatus which is automatically activated in conjunction with automatically opening up the automobile ignition circuit.

These together with still other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged side view of the fire extinguisher portion of the embodiment of the invention shown in FIG. 1.

FIG. 4 is a schematic diagram showing the interconnection of the major components of the embodiment of the invention shown in FIG. 1.

DESCRIPTION OF THE PREFERRED EMBODIMENT

Figure 1:
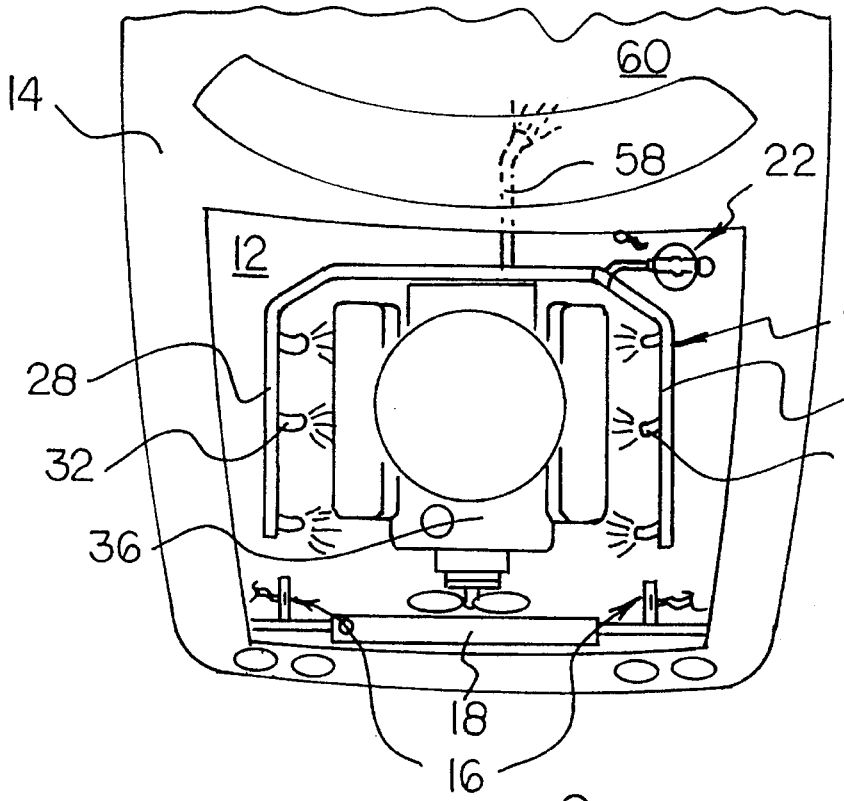
FIG. 1 is a top view showing a preferred embodiment of the vehicle engine fire extinguisher apparatus of the invention installed under the hood of a motor vehicle.

With reference to the drawings, a new and improved vehicle engine fire extinguisher apparatus embodying the principles and concepts of the present invention will be described.

Turning to FIGS. 1–8, there is shown an exemplary embodiment of the vehicle engine fire extinguisher apparatus of the invention which prevents and extinguishes fires in an engine compartment 12 of a motor vehicle 14. The apparatus includes a collision sensor assembly 16 supported by the motor vehicle 14 and a fire extinguisher module 22 supported by the motor vehicle 14. The fire extinguisher module 22 includes a valve assembly 24. The fire extinguisher module 22 may be supported by a module-support bracket assembly 53 (as shown in FIG. 3) which is supported by the motor vehicle 14. Valve control assembly 20 is electrically connected to the collision sensor assembly 16. The valve control assembly 20 is supported by the fire extinguisher module 22 and is employed for controlling the valve assembly 24. A manifold assembly 26 is supported by the motor vehicle 14 and is connected to the valve assembly 24. The manifold assembly 26 receives a quantity of fire extinguishant, which may be carbon dioxide or other suitable fire extinguishant, from the fire extinguisher module 22 when the valve assembly 24 is operated by the valve control assembly 20. The manifold assembly 26 includes a first manifold branch 28 which extends along a first side of the engine compartment 12 and includes a second manifold branch 30 which extends along a second side of the engine compartment 12. A plurality of first nozzle assemblies 32 are supported by and are arrayed along the first manifold branch 28. A plurality of second nozzle assemblies 34 are supported by and are arrayed along the second manifold branch 30. The first nozzle assemblies 32 and the second nozzle assemblies 34 direct flow of a quantity of fire extinguishant toward an engine 36 positioned between the first manifold branch 28 and the second manifold branch 30.

Figure 5:
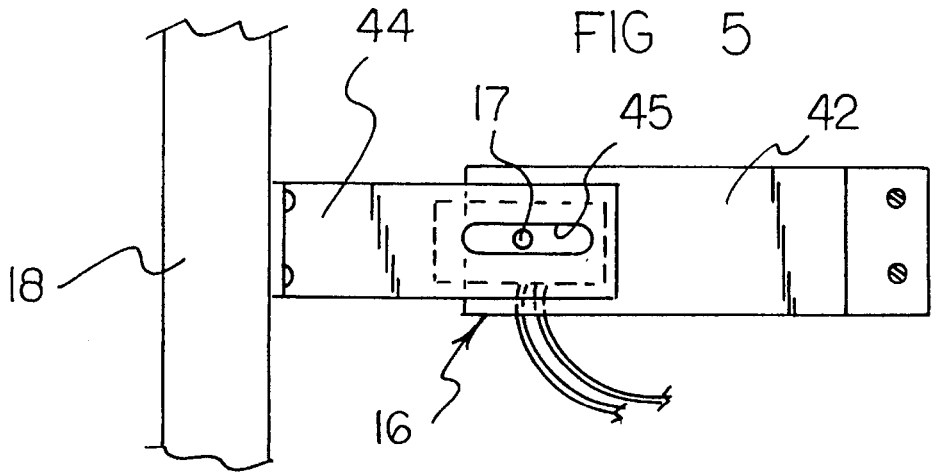
FIG. 5 is an enlarged top view of a radiator-activated sensor of the embodiment of the invention shown in FIG. 1.
Figure 6:
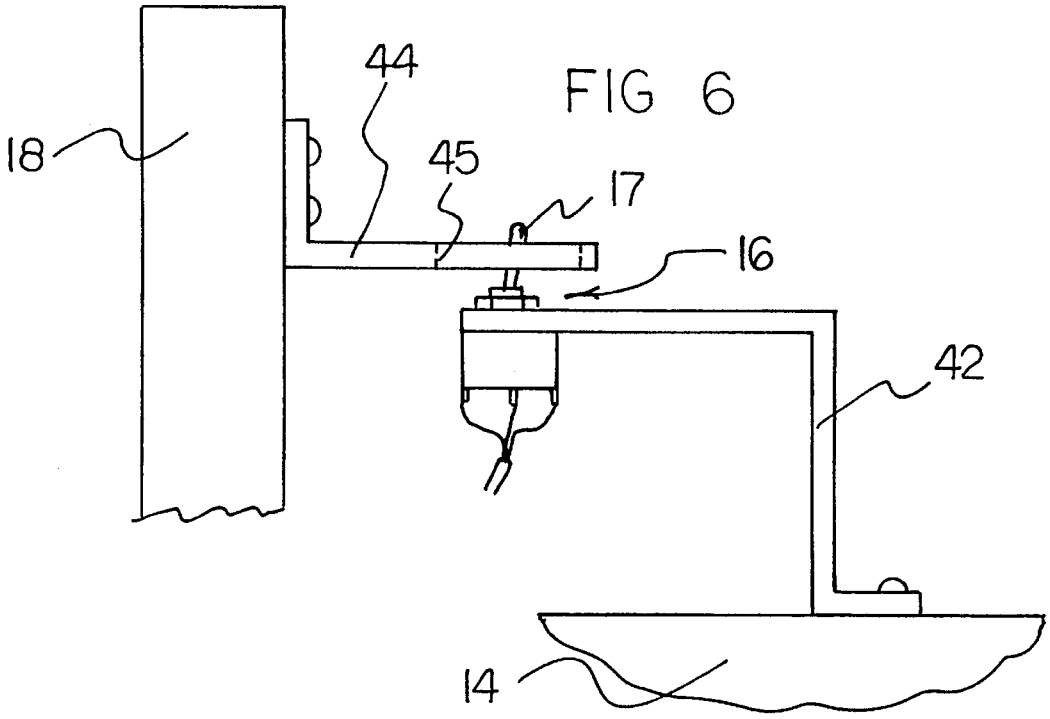
FIG. 6 is a side view of the radiator-activated sensor of the invention shown in FIG. 5.

As shown in detail in FIGS. 5 and 6, the collision sensor assembly 16 may be responsive to a collision-induced movement of a vehicle radiator assembly 18. In such a case, the collision sensor assembly 16 includes an activator arm 17. A collision-sensor-support bracket 42 is supported by the motor vehicle 14. The collision sensor assembly 16 is supported by the collision-sensor-support bracket 42, and a radiator-supported sensor activator 44 is supported by the vehicle radiator assembly 18. The radiator-supported sensor activator 44 operates the activator arm 17 of the collision sensor assembly 16 when a collision occurs and the vehicle radiator assembly 18 moves longitudinally towards or away from the motor vehicle 14.

The radiator-supported sensor activator 44 includes a slot portion 45 for receiving the activator arm 17 of the collision sensor assembly 16. More specifically, when a collision occurs, if the vehicle radiator assembly 18 moves either towards or away from the engine 36 a predetermined distance, the activator arm 17 moves within the slot portion 45 and reaches the end of the slot portion 45, whereby the activator arm 17 is moved and activates the collision sensor assembly 16. The length of the slot portion 45 and the degree of motion of the activator arm 17 of the collision sensor assembly 16 are calibrated so that the collision sensor assembly 16 is not activated unless a collision resulting from an impact at 25 miles per hour is experienced by the motor vehicle 14. Thereby, minor bumps or minor impacts, such as experienced in parallel parking, will not activate the valve control assembly 20.

More specifically, as shown in FIG. 1, two collision sensor assemblies 16 are employed. One collision sensor assembly 16 is positioned on a first end of the vehicle radiator assembly 18, and the other collision sensor assembly 16 is positioned on a second end of the vehicle radiator assembly 18. In this respect, one collision-sensor-support bracket 42 and one radiator-supported sensor activator 44 are positioned at the first end of the vehicle radiator assembly 18, and one collision-sensor-support bracket 42 and one radiator-supported sensor activator 44 are positioned at the second end of the vehicle radiator assembly 18.

It is noted that the radiator-supported sensor activators 44 need not be attached directly to the vehicle radiator assembly 18. Instead, the radiator-supported sensor activators 44 can be positioned on any radiator bracket that supports the vehicle radiator assembly 18 and that would move if the vehicle radiator assembly 18 were moved the predetermined distance during a collision.

As shown in detail in FIG. 3, the valve assembly 24 includes a first handle portion 25 and a second handle portion 27. The valve control assembly 20 includes a main-body portion 21 attached to the first handle portion 25 and includes a solenoid portion 23 connected to the second handle portion 27. The solenoid portion 23 moves the second handle portion 27 with respect to the first handle portion 25 to release a quantity of fire extinguishant from the fire extinguisher module 22 when the valve control assembly 20 is activated by the collision sensor assembly 16.

Figure 7:
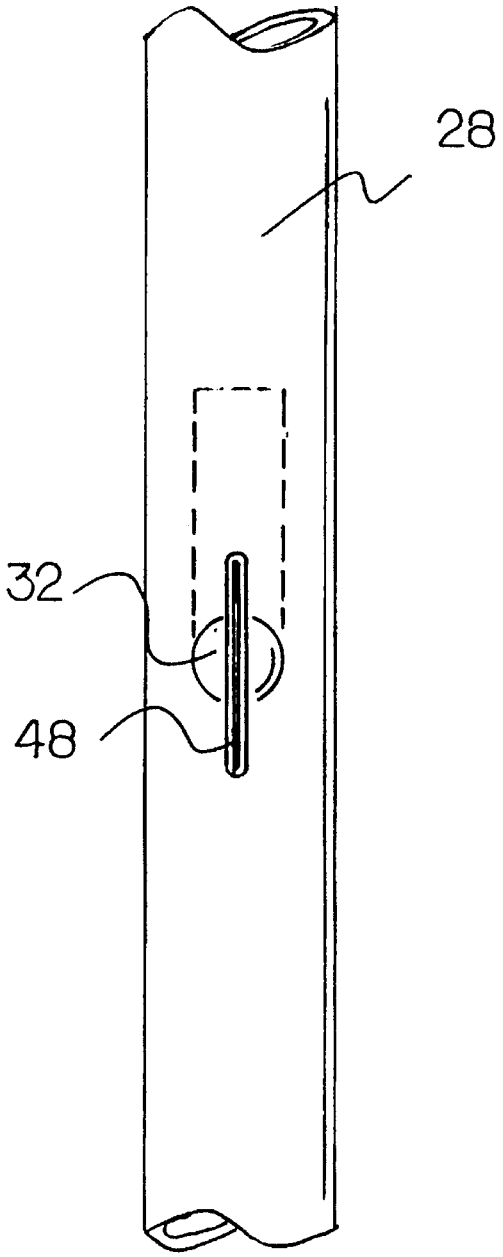
FIG. 7 is an enlarged side view of a nozzle portion of the manifold portion of the invention shown in FIG. 2.
Figure 8:
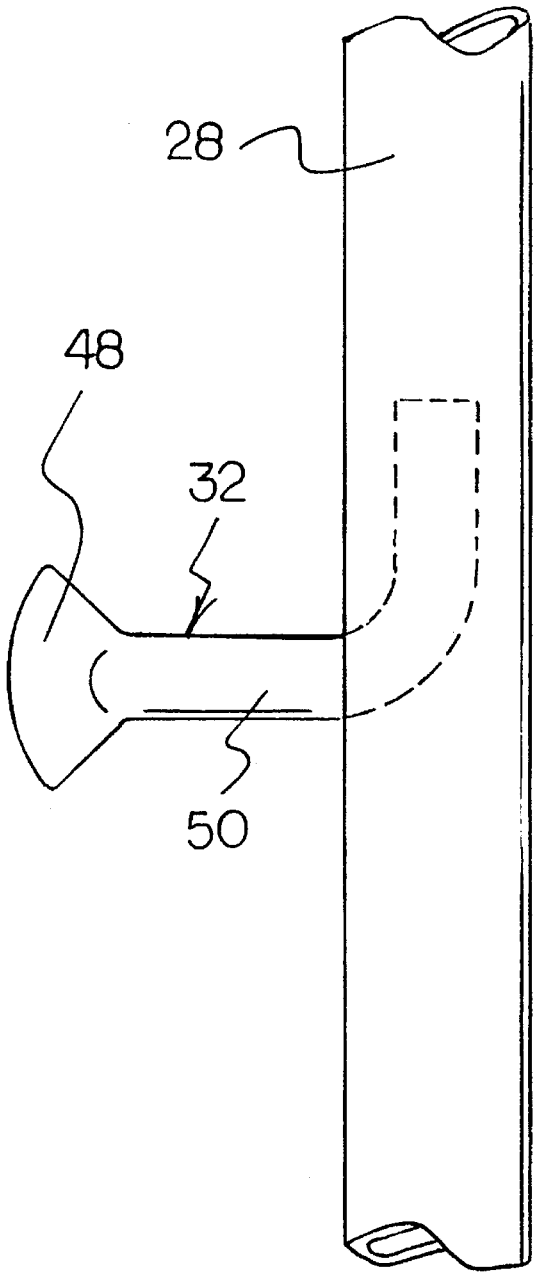
FIG. 8 is an enlarged top view of the nozzle portion of the manifold portion of the invention shown in FIG. 7.

As shown in detail in FIGS. 7 and 8, each of the first nozzle assemblies 32 and the second nozzle assemblies 34 includes a fan-shaped nozzle portion 48 and a fight-angled nozzle support portion 50 which supports the fan-shaped nozzle portion 48. Each nozzle support portion 50 is connected to a respective first manifold branch 28 or second manifold branch 30. The arrangement of first nozzle assemblies 32 and second nozzle assemblies 34 serve to provide an even distribution of the quantity of fire extinguishant inside the engine compartment 12. The fan-shaped nozzle portions 48 of the first and second nozzle assemblies serve to distribution the quantity of fire extinguishant over virtually the entire surface of the engine 36. The fan-shaped nozzle portion 48 may be made by squeezing the end portion of a right-angled piece of copper tubing. The remainder of the right-angled piece of copper tubing forms the nozzle support portion 50.

The manifold assembly 26 may include a passenger-compartment portion 58 which extends from the engine compartment 12 to a passenger compartment 60 of the motor vehicle 14.

Figure 2:
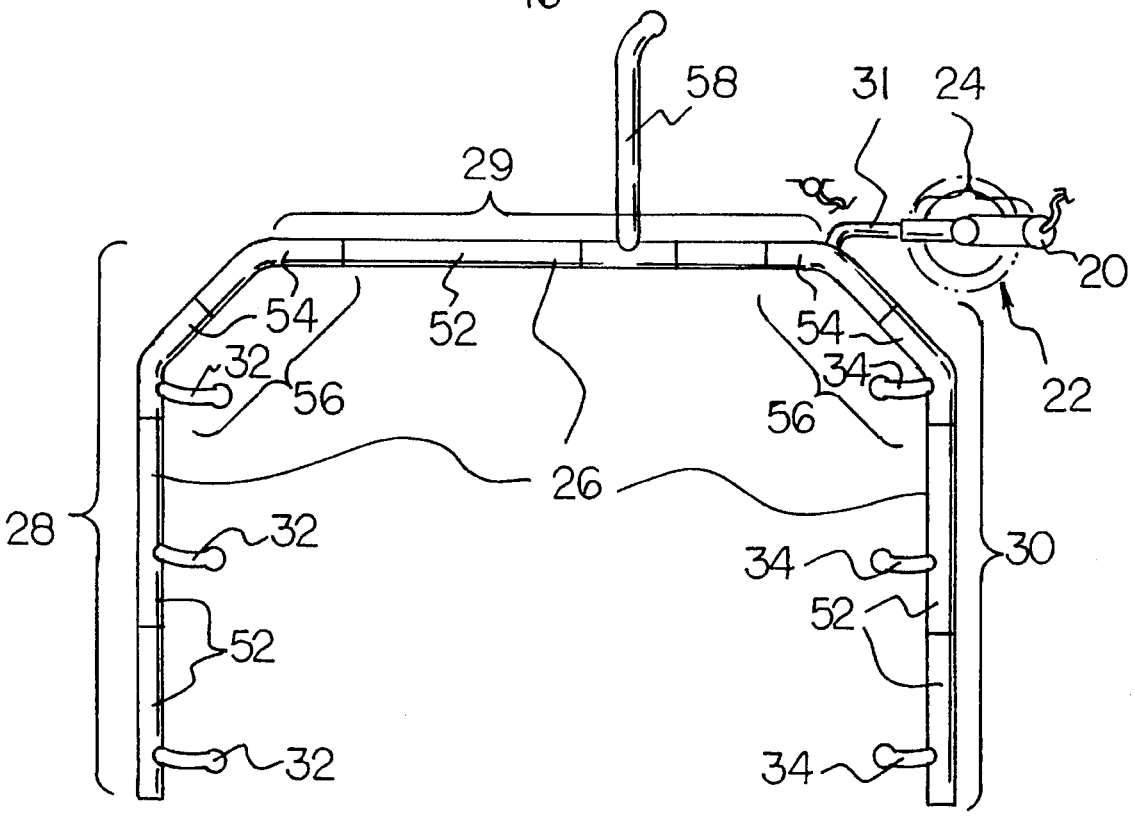
FIG. 2 is an enlarged view of the manifold portion of the embodiment of invention shown in FIG. 1.

As shown in detail in FIG. 2, the manifold assembly 26 is comprised of straight segments 52 and forty-five angular degree segments 54. In the manifold assembly 26, two forty-five angular degree segments 54 are connected in series to form a ninety degree angular bend 56.

A rollover sensor assembly 38 may also be employed. The rollover sensor assembly 38 is supported by the motor vehicle 14 and is electrically connected to the valve control assembly 20 substantially as shown in FIG. 4. In the event that the motor vehicle 14 turns over, the rollover sensor assembly 38 senses the rollover condition and signals the valve control assembly 20 to be activated to cause the quantity of fire extinguishant to be released from the fire extinguisher module 22. The rollover sensor assembly 38 can be comprised of a mercury switch 38.

A high-temperature sensor assembly 40 may also be employed. The high-temperature sensor assembly 40 is supported by the motor vehicle 14 and is electrically connected to the valve control assembly 20. In the event that a fire breaks out in the engine compartment 12, the high-temperature sensor assembly 40 senses the high-temperature condition caused by the fire and signals the valve control assembly 20 to be activated to cause the quantity of fire extinguishant to be released from the fire extinguisher module 22. The high-temperature sensor assembly 40 can be a heat detector such as disclosed in U.S. Pat. No. 3,568,774, incorporated herein by reference.

In operation of the vehicle engine fire extinguisher apparatus of the invention, with special reference to FIG. 4, each condition sensor is connected at one of their respective terminals to the positive side of the vehicle battery (not shown). The other of their respective terminals are connected to the positive terminal of the valve control assembly 20. More specifically, the collision sensor assemblies 16, the rollover sensor assembly 38, and the high-temperature sensor assembly 40 are connected in parallel between the positive terminal of the vehicle battery and the positive terminal of the valve control assembly 20. The negative terminal of the valve control assembly 20 is electrically is connected to the negative terminal of the vehicle battery. End terminals of each of the sensors can be connected to a connector block 62 supported by the motor vehicle 14. By the same token, an input lead 64 is connected between the connector block 62 and the valve control assembly 20.

When a monitored condition is sensed, whether it be a collision, a rollover, or a high temperature, the valve control assembly 20 serves to pull the second handle portion 27 of the valve assembly 24 toward the first handle portion 25, whereby a quantity of fire extinguishant exits from the fire extinguisher module 22 and enters the manifold assembly 26 through the tubing 31. The quantity of fire extinguishant passes into the first manifold branch 28, an intermediate portion 29, and the second manifold branch 30 of the manifold assembly 26. The quantity of fire extinguishant exits from the manifold assembly 26 through the first nozzle assemblies 32 and the second nozzle assemblies 34 and is directed to the engine 36 located between the first manifold branch 28 and the second manifold branch 30.

With respect to yet another feature of the invention, ignition-circuit-deactivator assembly 46 supported by the motor vehicle 14. The ignition-circuit-deactivator assembly 46 is connected to a portion of an ignition circuit for opening the ignition circuit in response to a sensed condition. The ignition-circuit-deactivator assembly 46 includes a solenoid activated switch assembly 46 connected in-line with the ignition circuit.

With respect to this feature of the invention, when any of the sensed conditions is sensed, be this a collision, a rollover, or a high temperature, the ignition-circuit-deactivator assembly 46 is activated, whereby the ignition circuit is opened up. More specifically, an end terminal of each sensor is connected to the connector block 62, and a lead line 66 is connected between the connector block 62 and the positive terminal of the ignition-circuit-deactivator assembly 46. The negative terminal of the ignition-circuit-deactivator assembly 46 is electrically is connected to the negative terminal of the vehicle battery.

The components of the vehicle engine fire extinguisher apparatus of the invention can be made from inexpensive and durable off-the-shelf components.

It is apparent from the above that the present invention accomplishes all of the objects set forth by providing a new and improved vehicle engine fire extinguisher apparatus that is low in cost, relatively simple in design and operation, and which may advantageously be located under the motor vehicle hood so that it need not be carried there from another location. With the invention, a vehicle engine fire extinguisher apparatus is provided which is automatically activated under the hood of a motor vehicle in the event of an under-hood fire. With the invention, a vehicle engine fire extinguisher apparatus is provided which uses off-the-shelf components that can be used for retrofitting a motor vehicle. With the invention, a vehicle engine fire extinguisher apparatus is provided which is automatically activated upon the occurrence of a collision, before a fire actually breaks out. With the invention, a vehicle engine fire extinguisher apparatus is provided which does not employ trip wires. With the invention, a vehicle engine fire extinguisher apparatus provides a reduction of concentration gradients of the fire extinguishant under the hood. With the invention, a vehicle engine fire extinguisher apparatus is provided which is specifically designed for substantially even distribution of the fire extinguishant under the hood. With the invention, a vehicle engine fire extinguisher apparatus is provided which is responsive to collision impact force on the radiator of the automobile. With the invention, a vehicle engine fire extinguisher apparatus is provided which is automatically activated when the vehicle rolls over. With the invention, a vehicle engine fire extinguisher apparatus is provided which is automatically activated in conjunction with automatically opening up the automobile ignition circuit.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by LETTERS PATENT of the United States is:

1. A fire extinguisher apparatus for preventing and extinguishing fires in an engine compartment of a motor vehicle, said apparatus comprising:

a collision sensor assembly supported by the motor vehicle, a fire extinguisher module supported by the motor vehicle, wherein said fire extinguisher module includes a valve assembly, a valve control assembly, electrically connected to said collision sensor assembly, wherein said valve control assembly is supported by said fire extinguisher module and is employed for controlling said valve assembly, a manifold assembly supported by said motor vehicle and connected to said valve assembly, wherein said manifold assembly receives a quantity of fire extinguishant from said fire extinguisher module when said valve assembly is operated by said valve control assembly, wherein said manifold assembly includes a first manifold branch which extends along a first side of the engine compartment and includes a second manifold branch which extends along a second side of the engine compartment, a plurality of first nozzle assemblies supported by and arrayed along said first manifold branch, and a plurality of second nozzle assemblies supported by and arrayed along said second manifold branch, wherein said first nozzle assemblies and said second nozzle assemblies direct flow of the quantity of fire extinguishant toward an engine positioned between said first manifold branch and said second manifold branch, wherein said collision sensor assembly is responsive to a collision-induced movement of a vehicle radiator assembly, wherein said collision sensor assembly includes an activator arm, said apparatus further including:

a collision-sensor-support bracket supported by said motor vehicle, wherein said collision sensor assembly is supported by said collision-sensor-support bracket, and a radiator-supported sensor activator supported by the vehicle radiator assembly, wherein said radiator-supported sensor activator operates said activator arm of said collision sensor assembly when a collision occurs and the vehicle radiator assembly moves longitudinally towards or away from the motor vehicle.

2. The apparatus of claim 1 wherein said radiator-supported sensor activator includes a slot portion for receiving said activator arm of said collision sensor assembly.

3. The apparatus of claim 1 wherein each said first nozzle assemblies and said second nozzle assemblies includes a fan-shaped nozzle portion and a right-angled nozzle support portion which supports said fan-shaped nozzle portion.

4. The apparatus of claim 1 wherein said manifold assembly includes a passenger-compartment portion which extends from the engine compartment to a passenger compartment of the motor vehicle.

5. The apparatus of claim 1 wherein said manifold assembly is comprised of straight segments and forty-five angular degree segments.

6. The apparatus of claim 5 wherein, in said manifold assembly, two of said forty-five angular degree segments are connected in series to form a ninety degree angular bend.

7. The apparatus of claim 1, further including:

a rollover sensor assembly supported by the motor vehicle and electrically connected to said valve control assembly.

8. The apparatus of claim 1, further including:

a high-temperature sensor assembly supported by the motor vehicle and electrically connected to said valve control assembly.

9. The apparatus of claim 1, further including:

an ignition-circuit-deactivator assembly supported by the motor vehicle, wherein said ignition-circuit-deactivator assembly is connected to a portion of an ignition circuit for opening the ignition circuit in response to a sensed condition.

10. The apparatus of claim 9 wherein said ignition-circuit-deactivator assembly includes a solenoid activated switch assembly connected in-line with the ignition circuit.

11. A fire extinguisher apparatus for preventing and extinguishing fires in an engine compartment of a motor vehicle, said apparatus comprising:

a collision sensor assembly supported by the motor vehicle, a fire extinguisher module supported by the motor vehicle, wherein said fire extinguisher module includes a valve assembly, a valve control assembly, electrically connected to said collision sensor assembly, wherein said valve control assembly is supported by said fire extinguisher module and is employed for controlling said valve assembly, a manifold assembly supported by said motor vehicle and connected to said valve assembly, wherein said manifold assembly receives a quantity of fire extinguishant from said fire extinguisher module when said valve assembly is operated by said valve control assembly, wherein said manifold assembly includes a first manifold branch which extends along a first side of the engine compartment and includes a second manifold branch which extends along a second side of the engine compartment, a plurality of first nozzle assemblies supported by and arrayed along said first manifold branch, and a plurality of second nozzle assemblies supported by and arrayed along said second manifold branch, wherein said first nozzle assemblies and said second nozzle assemblies direct flow of the quantity of fire extinguishant toward an engine positioned between said first manifold branch and said second manifold branch, wherein:

said valve assembly includes a first handle portion and a second handle portion, and said valve control assembly includes a main-body portion attached to said first handle portion and includes a solenoid portion connected to said second handle portion.

* * * * *